US008542859B2

(12) United States Patent
Alden

(10) Patent No.: US 8,542,859 B2
(45) Date of Patent: Sep. 24, 2013

(54) INTERCHANGEABLE HEADPHONE AUDIO SYSTEM

(75) Inventor: Richard P Alden, Park City, UT (US)

(73) Assignee: Skullcandy, Inc., Park City, UT (US)

( * ) Notice: Subject to any disclaimer, the term of this patent is extended or adjusted under 35 U.S.C. 154(b) by 0 days.

(21) Appl. No.: 12/664,189

(22) PCT Filed: Nov. 25, 2009

(86) PCT No.: PCT/US2009/065926
§ 371 (c)(1),
(2), (4) Date: Dec. 11, 2009

(87) PCT Pub. No.: WO2010/068495
PCT Pub. Date: Jun. 17, 2010

(65) Prior Publication Data

US 2011/0235819 A1 Sep. 29, 2011

Related U.S. Application Data

(60) Provisional application No. 61/117,866, filed on Nov. 25, 2008.

(51) Int. Cl.
*H04R 25/00* (2006.01)

(52) U.S. Cl.
USPC ..... 381/376; 381/367

(58) Field of Classification Search
USPC ..... 381/380, 381, 384, 376, 367, 370
See application file for complete search history.

(56) References Cited

U.S. PATENT DOCUMENTS 1,329,029 A * 1/1920 Timmons ..... 379/430
1,418,388 A * 6/1922 Miessner ..... 381/382
3,938,614 A 2/1976 Ahs
5,551,089 A 9/1996 Whidden
5,625,903 A * 5/1997 Schultz et al. ..... 2/209
7,245,736 B2 7/2007 Tsunoda et al.

(Continued)

FOREIGN PATENT DOCUMENTS

KR 200220309 4/2001
KR 20020052658 9/2003

(Continued)

OTHER PUBLICATIONS

International Search Report on PCT/US2009/065926, mailed Jul. 9, 2010.

Opinion of the International Searching Authority on PCT/US2009/065926, mailed Jul. 9, 2010.

*Primary Examiner* — Davetta W Goins
*Assistant Examiner* — Amir Etesam
(74) *Attorney, Agent, or Firm* — TraskBritt

(57) ABSTRACT

A configurable audio system for use in a plurality of different settings includes a set of speaker assemblies that can be attached, detached and reattached to a plurality of different accessories configured for use in specific settings (e.g., ski goggles, or conventional headphones). In one implementation, each accessory comprises a set of engagement assemblies for detachably receiving the set of speaker assemblies. For example, a strap on a pair of goggles can comprise a set of engagement assemblies affixed in-line with the strap. By contrast, a traditional headphone band can comprise a pair of engagement assemblies that extend from each opposing end of the traditional headphone band. In either case, each engagement assembly of the goggle strap or the traditional headphone band is configured in size and shape to attach to, and detach from, each speaker assembly, as desired.

19 Claims, 8 Drawing Sheets

(56) References Cited

U.S. PATENT DOCUMENTS

| | | | | |
|---|---|---|---|---|
| 7,388,960 | B2 | 6/2008 | Kuo et al. | |
| 2002/0094094 | A1* | 7/2002 | Shin | 381/104 |
| 2003/0007660 | A1 | 1/2003 | Tsunoda et al. | |
| 2005/0008184 | A1 | 1/2005 | Ito et al. | |
| 2010/0111349 | A1* | 5/2010 | Devlas et al. | 381/380 |

FOREIGN PATENT DOCUMENTS

| | | |
|---|---|---|
| KR | 20040065582 | 7/2004 |
| KR | 100631863 | 10/2006 |
| WO | 03053096 | 6/2003 |

* cited by examiner

INTERCHANGEABLE HEADPHONE AUDIO SYSTEM

CROSS-REFERENCE TO RELATED APPLICATIONS

This application claims the benefit of, and priority to, International Application Ser. No. PCT/US2009/065926, filed on Nov. 25, 2009 and titled "Interchangeable Headphone Audio System," which claims priority to U.S. Provisional Patent Application Ser. No. 61/117,866, filed on Nov. 25, 2008 and titled "INTERCHANGEABLE GOGGLE AND HEADPHONE AUDIO SYSTEM," both of which are hereby incorporated herein in its entirety by this reference.

BACKGROUND OF THE INVENTION

1. Field of the Invention

The present disclosure is generally related to portable audio systems and to interchangeable headphone audio systems in particular.

2. Background and Relevant Art

Conventional portable audio systems often include a pair of headphones that are connected to a media player (e.g., with one or more wires). Due to advances in portable audio system technology, users have an increased desire and ability to use the portable audio system in a variety of settings. For example, many portable audio systems are now lightweight, small, and have a much greater media storage capacity than prior portable audio systems. Moreover, many media players allow a user to customize the media selection, such as to suit the user's mood and/or the activity the user is pursuing. Thus, it is increasingly common for users to use portable audio systems when engaging in a variety of indoor as well as outdoor activities.

It is increasingly common for outdoor enthusiasts to use portable audio systems. For example, skiers, snowboarders, hikers, and mountain climbers may desire to listen to audio media when participating in their respective outdoor activities. With conventional portable audio systems, the user may favor smaller, in-the-ear style headphones when participating in outdoor activities, because helmets, ski goggles, ear protectors, and headbands can easily fit over the in-the-ear style headphones.

Although the user gains portability during outdoor activities with in-the-ear style headphones, the user may sacrifice sound quality and comfort as in-the-ear headphones may provide poor audio quality and/or be uncomfortable. Moreover, in-the-ear style headphones may fall out of the user's ear during participation in the outdoor activity, thus frustrating the user and preventing the user from enjoying the portable audio system during the activity.

Due to the disadvantages with in-the-ear style headphones, the user may choose to use larger, over-the-ear style headphones when not participating in outdoor activities. For example, a user may use the over-the-ear headphones in a home, school, or office environment. The over-the-ear style headphones may provide better sound quality and comfort for indoor use, but typically the over-the-ear style headphones are not compatible with outdoor activities because helmets, ski goggles, ear protectors, and headbands may interfere with the use of over-the-ear headphones.

Therefore, although the user uses the same media player in both instances (e.g., in outdoor and home environments), the user will likely need at least two different sets of headphones for the two different use environments. In particular, it is not uncommon for users of portable audio systems to have several different sets of headphones, each of which are used in a different environment.

BRIEF SUMMARY OF THE INVENTION

Implementations of the present invention comprise devices, systems, and methods, for using interchangeable headphones in connection with a variety of different use environments. In particular, example implementations of the invention provide a single set of interchangeable headphones that a user can wear while participating in outdoor activities, or, alternatively, in more casual environments, such as the home or office, thus eliminating the need for the user to own multiple sets of headphones. Accordingly, a user of the interchangeable headphones can use the same, preferred set of headphones in virtually any environment while performing virtually any activity.

For example, an audio system configured for interchanging a plurality of speaker assemblies onto a variety of different accessories can include a first set of engagement assemblies attached to a first apparatus that is configured in size and shape to be worn about the head of a user. The audio system can also include a second set of engagement assemblies attached to a second apparatus that is configured in size and shape to be worn about the head of the user. In both cases, the first and second set of engagement assemblies is configured to be positioned about a user's ears when the user is wearing either the first or second apparatus. In addition, the audio system can include a plurality of speaker assemblies configured in size and shape to removably attach to either of the first set of engagement assemblies or the second set of engagement assemblies, and to connect to a media player.

In addition, a kit configured to use a single set of speaker assemblies in a wide range of settings can include a set of two speaker assemblies. Each speaker assembly in the set can include a housing having at least two recesses defined therein, and a local socket ending proximate to the speaker assembly and being removably coupled to a wire harness. The kit can also include a set of goggles having a strap comprising two engagement assemblies affixed in-line with the strap. Each engagement assembly for the goggles can include at least one engagement ring. In addition, the kit can include a headband comprising a set of two engagement assemblies extending from the headband. Each engagement assembly for the headband includes opposing arms. In both the goggle and headband cases, each of the engagement assemblies are configured in size, shape, and material to flexibly snap into or out of the at least two recesses of each speaker assembly in the set.

Additional features and advantages of exemplary implementations of the invention will be set forth in the following description, and in part will be obvious from the description, or may be learned by the practice of such exemplary implementations. The features and advantages of such implementations may be realized and obtained by means of the instruments and combinations particularly pointed out in the appended claims. These and other features will become more fully apparent from the following description and appended claims, or may be learned by the practice of such exemplary implementations as set forth hereinafter.

BRIEF DESCRIPTION OF THE DRAWINGS

In order to describe the manner in which the above-recited and other advantages and features of the invention can be obtained, a more particular description of the invention briefly described above will be rendered by reference to specific embodiments thereof that are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

Implementations of the present invention comprise devices, systems, and methods, for using interchangeable headphones in connection with a variety of different use environments. In particular, example implementations of the invention provide a single set of interchangeable headphones that a user can wear while participating in outdoor activities, or, alternatively, in more casual environments, such as the home or office, thus eliminating the need for the user to own multiple sets of headphones. Accordingly, a user of the interchangeable headphones can use the same, preferred set of headphones in virtually any environment while performing virtually any activity.

The interchangeable headphones described below can include various graphic designs, logos, colors, shapes, decoration, artwork and the like that add to the overall aesthetic of the interchangeable headphones. In particular, a designer can design the interchangeable headphones to match corresponding accessories to which the interchangeable headphones attach. Moreover, a user can mix and match various designs and styles of the interchangeable headphones with various designs and styles of accessories to create a unique appearance and feel depending on the mood or activity in which the user is participating.

Figure 1B:
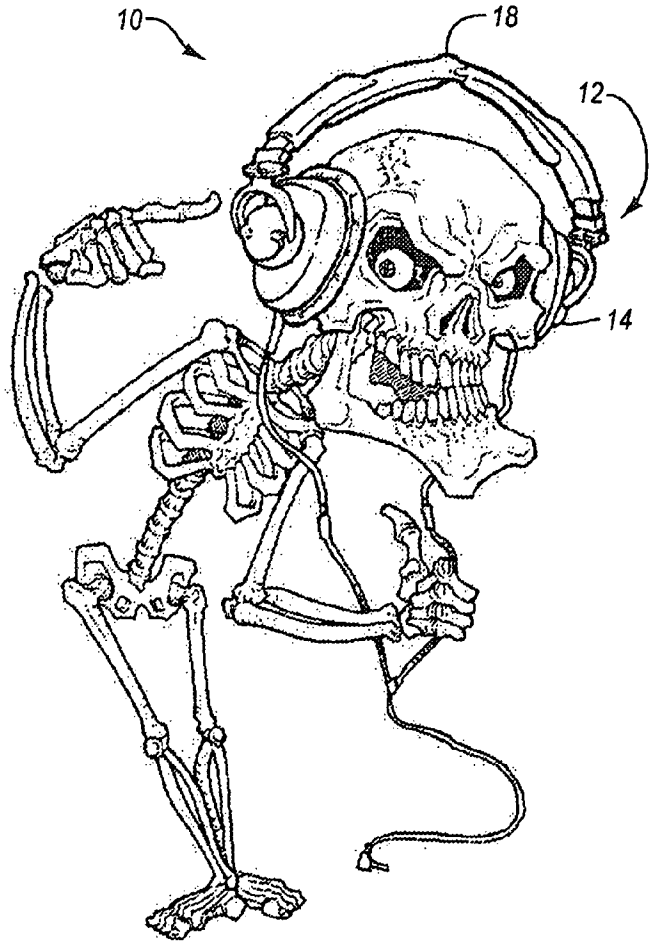
FIG. 1B illustrates the rendering illustrated in FIG. 1A, but associated with a headband according to an implementation of the present invention.
Figure 1A:
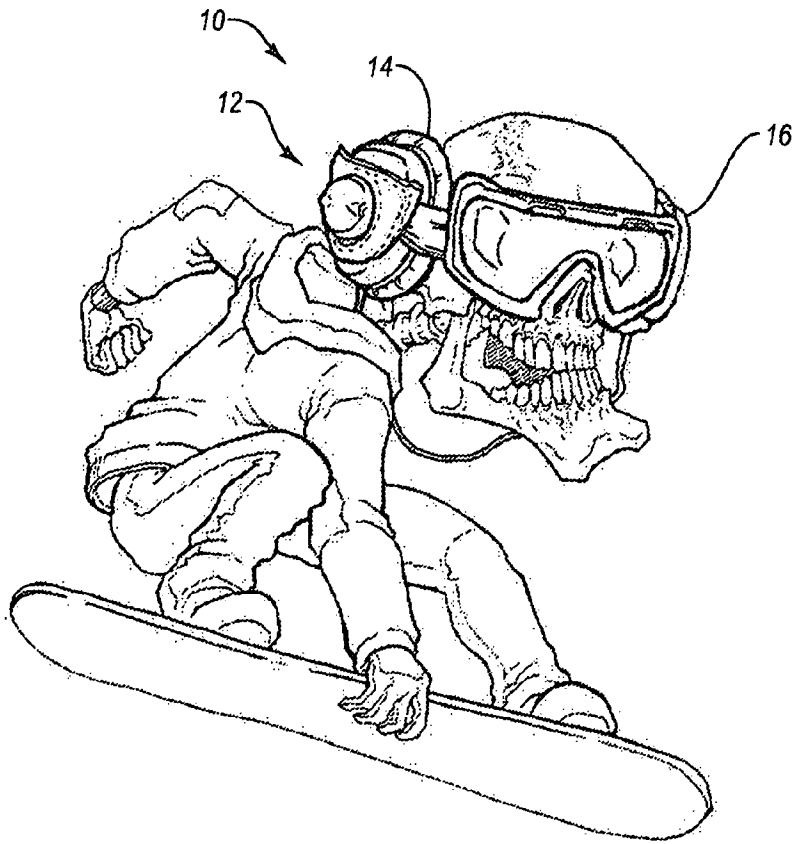
FIG. 1A illustrates an artistic rendering of interchangeable headphones associated with snowboard goggles according to an implementation of the present invention.

FIGS. 1A and 1B illustrate a user 10 using an example portable audio system 12. The portable audio system 12 can include a media player. As illustrated in FIG. 1A, the user can place the media player within the user's clothing such that the media player is not visible while in use. In one example implementation, the media player is an MP3 player, or similar digital media playing device, configured to store, process, and communicate media content. Other example embodiments of media players include wireless phones, cell phones, CD players, cassette players, or any other media playing device.

In addition to the media player, the portable audio system 12 may further include interchangeable headphones 14. The interchangeable headphones 14 can be configured to interchange between various accessories such that the user can use the same interchangeable headphones 14 in various environments. In particular, FIG. 1A illustrates the user 10 employing the interchangeable headphones 14 when snowboarding. As illustrated in FIG. 1A, the interchangeable headphones 14 can be associated with the user's sports accessories, for example, goggles 16. Associating the interchangeable headphones 14 with the user's goggles 16 allows the user to listen to audio media while reducing or eliminating peripheral headbands. Moreover, such a configuration can provide for a comfortable and natural fit, as well as an overall seamless appearance, which can enhance the outdoor experience by allowing users to listen to media with a high degree of comfort and good sound quality.

In contrast, FIG. 1B illustrates the user 10 employing the same interchangeable headphones 14 in a casual setting. As illustrated in FIG. 1B, the interchangeable headphones 14 can also be associated with a traditional headphone band 18. Associating the interchangeable headphones 14 with the traditional headphone band 18 allows the user 10 to employ the same set of interchangeable headphones 14 when in an environment that does not require the goggles 16, such as at home or in the office. Thus, the ability of the interchangeable headphones 14 to interchange with various accessories can reduce or eliminate the need for the user 10 to purchase and store several different headphone models and styles to accommodate varying use environments.

Although FIGS. 1A and 1B illustrate the interchangeable headphones 14 associated with accessories that include goggles 16 and the traditional headphone band 18, the present invention is not limited to such specifically-illustrated implementations. In other example implementations, the interchangeable headphones 14 can be associated with various other accessories depending on the use environment. For example, in addition to the implementations shown in FIGS. 1A and 1B, the interchangeable headphones 14 can be associated with sunglasses, helmets, beanies, hoods, coat collars, sweatbands, hats and any other piece of equipment or clothing a user might wear while participating in a particular activity. Moreover, the interchangeable headphones 14 can be associated with various styles of headbands in addition to the traditional headband 18. For example, the interchangeable headphones 14 can be associated with around-the-neck headbands, behind-the-head headbands, and any other style or configuration of headband.

As will be discussed in more detail below, a user can easily and efficiently interchange the interchangeable headphones 14 between the various accessories. For example, the interchangeable headphones 14 can be configured to seamlessly interchange between the goggles 16 illustrated in FIG. 1A and the traditional headband 18 illustrated in FIG. 1B. In other words, the interchangeable headphones 14 can be disconnected and removed from the goggles 16, for example, and subsequently connected to the traditional headband 18. In at least one implementation, no additional tool is needed to affect the disconnection and connection of the interchangeable headphones 14.

Figure 2A:
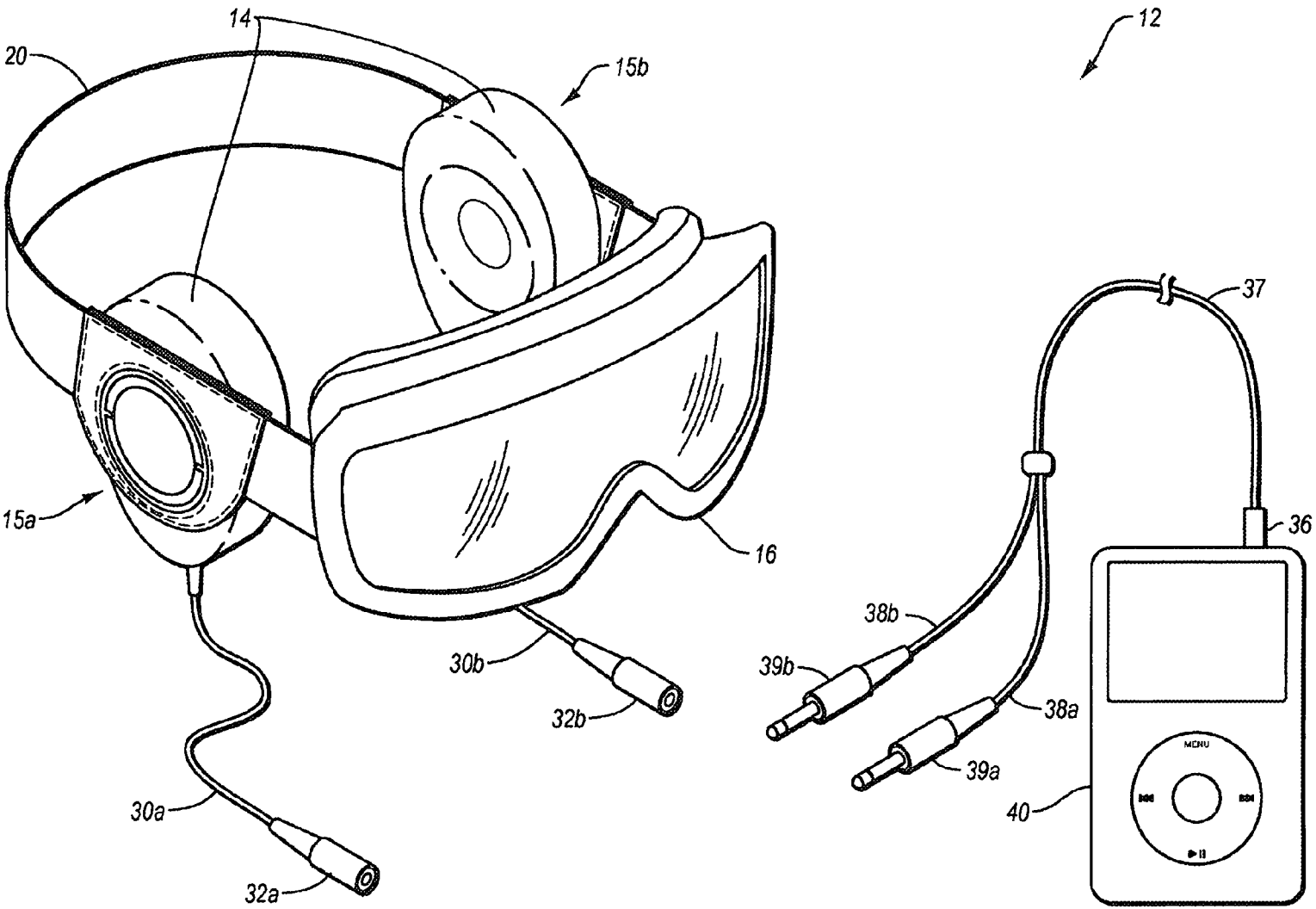
FIG. 2A illustrates various example components of the interchangeable headphones with respect to an association with snowboard goggles.

FIG. 2A illustrates one example implementation in which the portable audio system 12 that includes a media player 40 and the interchangeable headphones 14 that are associated with the goggles 16. The interchangeable headphones 14 can include speaker assemblies 15*a* and 15*b* that receive an audio signal from the media player 40 and transform the audio signal into sound waves audible to a human ear. In one example implementation, the speaker assemblies 15*a* and 15*b* can have an over-the-ear configuration, as shown in FIG. 2A. In alternative implementations, however, the speaker assemblies 15*a* and 15*b* can have an on-the-ear configuration, or an in-the-ear configuration. Moreover, the speaker assemblies 15*a* and 15*b* can be configured to not rest on or in the ear; rather, the speaker assemblies 15*a* and 15*b* can be positioned simply near enough to the ear to allow the user to hear the sound waves produced from the speaker assemblies 15*a* and 15*b*.

Notwithstanding the style or configuration of the speaker assemblies 15*a* and 15*b*, the speaker assemblies 15*a* and 15*b* can be connected to the media player 40 to receive an audio signal, as mentioned above. FIG. 2A illustrates one example implementation where the speaker assemblies 15*a*, 15*b* can be connected (or are connectable) to the media player 40 by way of an electrical wire(s). In particular, FIG. 2A illustrates one example implementation of an electrical wire configuration that can be used to communicably connect the speaker assemblies 15*a* and 15*b* with the media player 40.

As shown in FIG. 2A, the speaker assemblies 15*a*, 15*b* can be operatively connected to local wires 30*a* and 30*b*, respectively, with each local wire 30*a*, 30*b* including a female socket 32*a* and 32*b*. The female sockets 32*a*, 32*b* are configured to be selectively connected to a main wire 37. For example, a user can connect the main wire 37 to the media player 40 with a plug 36 on a first end, and connect the main wire 37 to the local wires 30*a*, 30*b* on a second end. In one example implementation, the main wire 37 can split into two single wires 38*a* and 38*b*, each of which comprise a male connector 39*a* and 39*b* on the end thereof. The male connectors 39*a* and 39*b* are configured to selectively connect with the female sockets 32*a* and 32*b*, respectively, thus completing the wired connection between the media player 40 and the speaker assemblies 15*a* and 15*b*.

In general, the male connectors 39*a* and 39*b*, illustrated as conventional audio jack plugs, can be any size, including one-eighth inch and one-quarter inch jacks. Of course, in alternative implementations, one will appreciate that male connectors 39*a* and 39*b* can also comprise other electrical connector interfaces, including USB, Fire Wire, i-Link, or other electrical connector interfaces. In any case, and however configured, when the male connectors 39*a* and 39*b* are coupled to the female sockets 32*a* and 32*b*, and the plug 36 is received by the media player 40, a wire path is formed between the media player 40 and the speaker assemblies 15*a*, 15*b* for transmitting and/or receiving audio signals.

The electrical wire configuration, illustrated in FIG. 2A, provides the user with several benefits when using the interchangeable headphones 14. For example, the local wires 30*a* and 30*b* are relatively short such that when disconnected from the main wire 37, the local wires 30*a* and 30*b* do not get tangled or snagged on the user's clothing or equipment. Moreover, the female sockets 32*a* and 32*b* allow a user to decouple the local wires 30*a* and 30*b*, and thus the speaker assemblies 15*a* and 15*b*, from the main wire 37 and associated media player 40. This allows a user to easily place the media player 40 within clothing, such as a snowboarding jacket, and then connect the media player 40 to the speaker assemblies 15*a* and 15*b* without having to run the speaker assemblies 15*a* and 15*b* through the clothing.

In addition to the above benefits, a manufacturer/engineer can configure the female sockets 32*a* and 32*b* and the male connectors 39*a* and 39*b* to provide a sufficient connection tension such that the female sockets 32*a* and 32*b* do not disconnect from the male connectors 39*a* and 39*b* while in use. For example, when a user is participating in an outdoor activity, such as snowboarding, a part of the wire path may become snagged or may pull due to the user's movements. Thus, the connection tension between the female sockets 32*a*, 32*b* and the male connectors 39*a*, 39*b* can be configured to resist disconnecting upon becoming snagged or pulled due to the user's movements. At the same time, a manufacturer/engineer can calibrate the connection tension such that the user can purposely disconnect the female sockets 32*a*, 32*b* from the male connectors 39*a*, 39*b* when desired. The manufacturer/engineer can calibrate the connection tension by varying slip tolerances between the female sockets 32*a*, 32*b* and male connectors 39*a*, 39*b* and/or providing a latch or similar feature.

In addition to the electrical wire configuration explained above, and illustrated in FIG. 2A, a manufacturer/engineer can use other electrical wire configurations to communicably connect the media player 40 to the speaker assemblies 15*a* and 15*b*. For example, in an alternative embodiment illustrated in FIG. 2B, the local wires 30*a* and 30*b* can join together and end in a single female socket 32. In this implementation, the main wire 37 does not split, but rather is a single wire that ends in a single male connector 34 and is configured to connect with the single female socket 32.

Figure 2C:
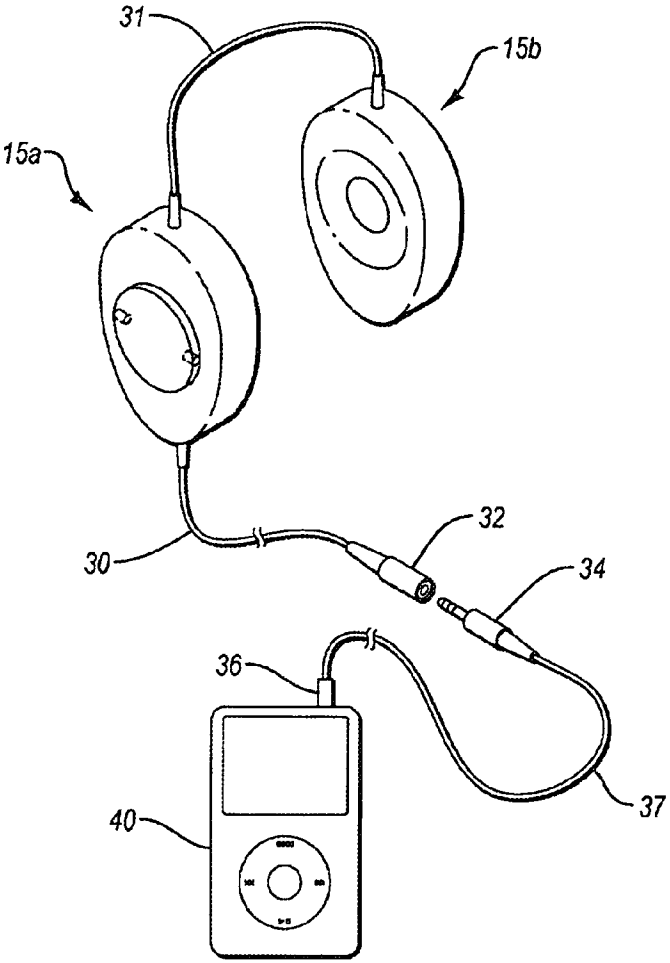
FIGS. 2B and 2C illustrate example implementations of the wired connection between example interchangeable headphones and an example media player.

Moreover, in another implementation, and as illustrated in FIG. 2C, an manufacturer/engineer can make a direct electrical connection 31 between the speaker assemblies 15*a* and 15*b*, such that it is necessary to only have one local wire 30 that can extend from speaker assembly 15*a* and connect to the main wire 37. Various other wire configurations can be employed, depending on the overall configuration of the media player 40 and interchangeable headphones 14.

Figure 2B:
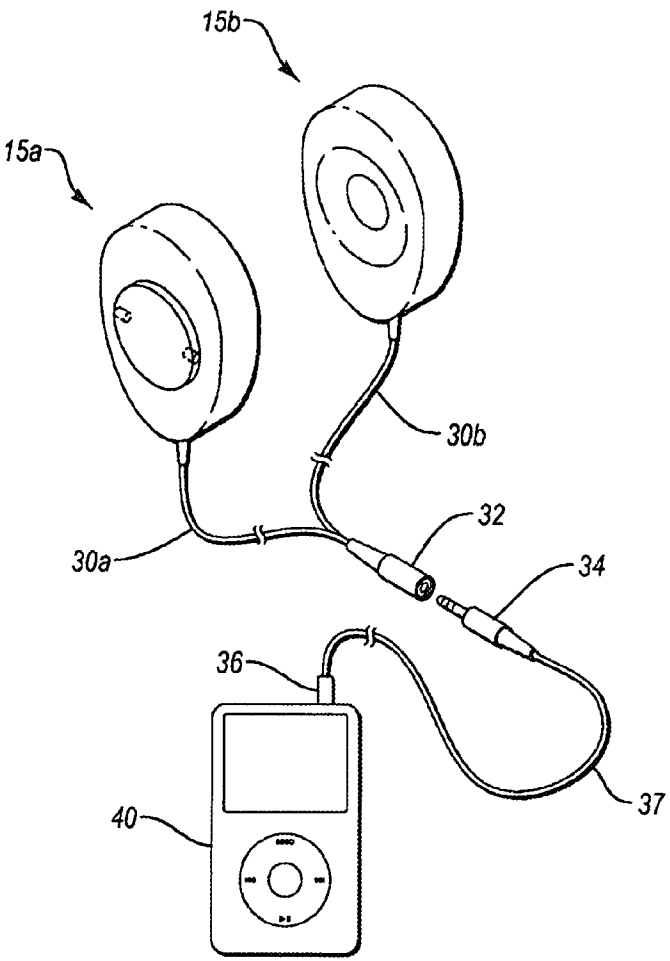

Although FIGS. 2A-2C illustrate implementations where the speaker assemblies 15*a* and 15*b* have electrically wired connections to the media player 40, an alternative implementation can have a wireless configuration. For example, a manufacturer/engineer can configure the speaker assemblies 15*a* and 15*b* with one or more wireless transceivers for receiving communication from, and/or sending communications to, a wirelessly enabled media player 40. One will appreciate that the speaker assemblies 15*a* and 15*b* can employ one or more wireless communication protocols, including BLUETOOTH® or alternative wireless communication protocols.

Regardless of whether the speaker assemblies 15*a* and 15*b* utilize a wired or wireless configuration, one or both of the speaker assemblies 15*a* and 15*b* can incorporate a microphone configured to transmit the user's voice. In one example implementation, there can be a wired dongle that is separate or in-line with the local wire(s) 30*a* and/or 30*b*. In another implementation, the speaker assemblies 15*a* and 15*b* can integrally incorporate the microphone within the actual speaker assembly 15*a* and/or 15*b*.

In any event, a user can use the microphone to transmit their voice, i.e., through an audio signal, from the microphone to the media player 40. The microphone feature is especially useful when the media player 40 is a wireless phone or cell phone, for example, since the speaker assemblies 15*a* and 15*b* and microphone can function as a wireless phone headset to allow the user to make and place a call on the wireless phone.

In addition to the above described connections/connectors, FIG. 2A further illustrates an implementation in which the interchangeable headphones 14 are associated with goggles 16. In particular, the speaker assemblies 15*a* and 15*b* are coupled to the goggle strap 20 in a location that substantially aligns with the user's ear when the user wears the goggles 16. In one example implementation, the goggle strap 20 can include a flexible material that can provide a comfortable fit for the user (i.e., conforming about the user's head) while helping maintain the goggles 16 in place on the user's face and the speaker assemblies 15*a*, 15*b* in place relative to the user's ears.

As mentioned above, the interchangeable headphones 14 can be associated with various other accessories other than goggles 16 (e.g., sunglasses, helmets, beanies, hoods, coat collars, sweatbands, and hats). In these other example implementations, the speaker assemblies 15*a* and 15*b* can be associated with the various other accessories in a similar manner as with the goggles 16. In particular, the interchangeable headphones 14 can connect to the various accessories in an integral configuration, using a portion or portions of the accessory's natural configuration to support the speaker assemblies 15*a* and 15*b*.

For example, a manufacture/designer can integrate the interchangeable headphones 14 into the sides of a beanie or helmet such that the speaker assemblies 15*a* and 15*b*, when coupled to the beanie or helmet, align with the user's ears. Alternatively, a strap, such as the one illustrated in FIG. 2A, can be added to the beanie or helmet to support the speaker assemblies 15*a* and 15*b*. However configured, each implementation provides the ability for a user to snap a particular speaker assembly into and out of a given engagement assembly.

Figure 3B:
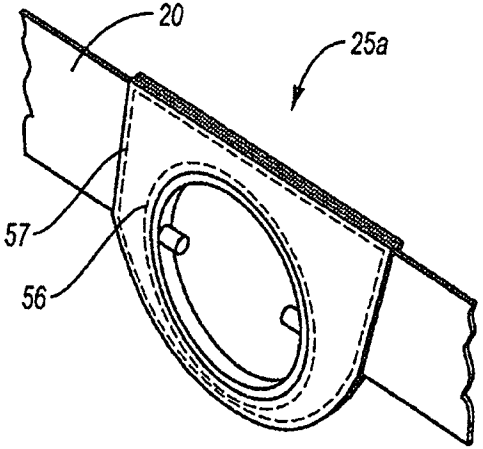
FIG. 3B illustrates an assembled view of an engagement assembly shown in FIG. 3A.
Figure 3C:
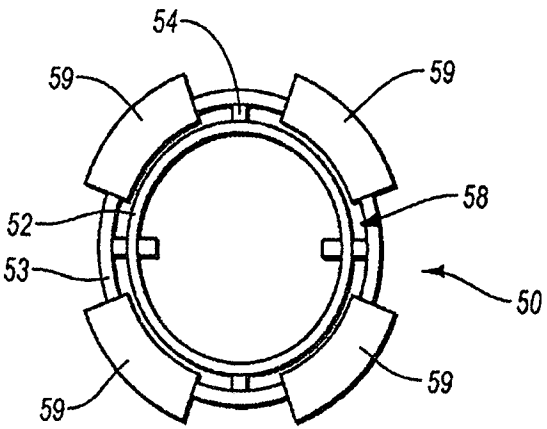
FIG. 3C illustrates an front view of an engagement assembly shown in FIG. 3A.
Figure 3A:
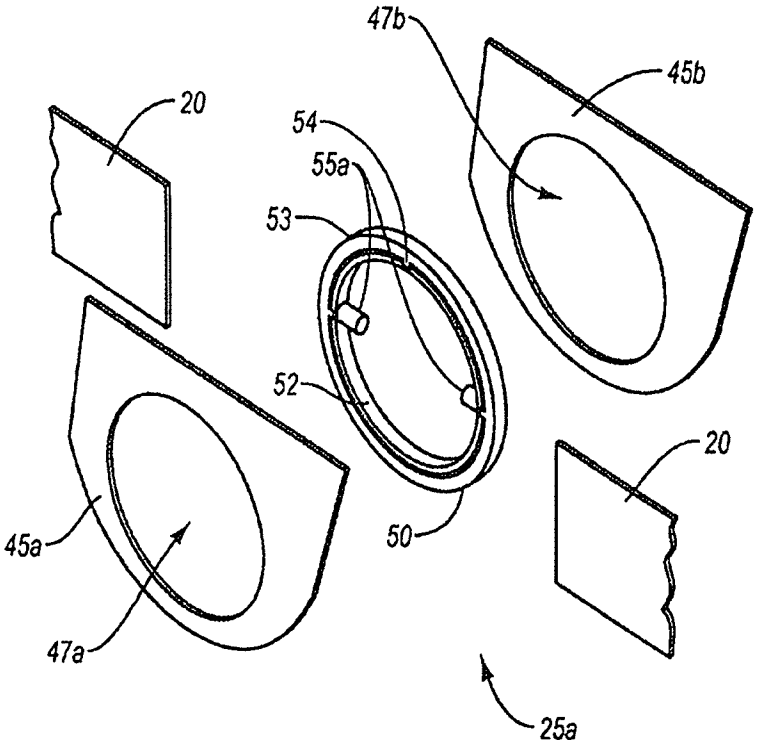
FIG. 3A illustrates an exploded view of an engagement assembly according to an implementation of the present invention.

FIGS. 3A and 3B illustrate in more detail example components used to retain the speaker assemblies 15*a* and 15*b* (FIGS. 2A-2C) when sewn in line with goggle strap 20. As discussed above, these components may be employed with a variety of example accessories, but for purposes of explanation, the components will be discussed with respect to the goggle strap 20. In particular, FIG. 3A illustrates an exploded view of one implementation of an engagement assembly (i.e., 25*a*). As illustrated in FIG. 3A, this implementation of engagement assembly 25*a* generally includes side portions 45*a* and 45*b*. The side portions 45*a*, 45*b* have openings 47*a*, 47*b* defined therein. The openings 47*a*, 47*b* provide access to an engagement ring 50 that may be secured between side portions 45*a* and 45*b*.

The side portions 45*a*, 45*b* can vary from one implementation to the next. For example, the material of the side portions 45*a*, 45*b* can vary. In one example implementation, the side portions 45*a*, 45*b* are made from a vinyl or similar type of material. Alternative side portions 45*a*, 45*b* materials include leather or fabric. In one example implementation, the side portions 45*a*, 45*b* can be made from the same material as the strap 20.

Depending on the type of side portion 45*a*, 45*b* material, the manner of connection of the side portions 45*a*, 45*b* to the goggle strap 20 can vary from one implementation to another. For example, and as illustrated in FIG. 3B, the side portions 45*a*, 45*b* of FIG. 3A can be connected to the strap 20 using stitching 57. In particular, the stitching 57 can use a thread of material that passes through the side portion 45*a*, through the strap 20, and through the side portion 45*b* to secure side portions 45*a*, 45*b* to the strap 20 and to the secure the side portions 45*a*, 45*b* together. In alternative implementations, the side portions 45*a*, 45*b* can connect to the strap 20 with an adhesive, rivets, or any other similar methods or devices. In still further implementation, the side portions 45*a*, 45*b* can be configured to slide on or clip to a pre-existing strap 20 (e.g., FIGS. 5A and 5B). Further, it will be appreciated that the goggle strap 20, and the side portions 45*a*, 45*b*, can be combined in any suitable manner that places the engagement assembly 25*a* in-line with the goggle strap 20.

In addition to varying the manner of connection of the side portions 45*a*, 45*b* to the strap 20, the geometric configuration of the side portions 45*a*, 45*b* may also vary. For example, and as illustrated in FIG. 3A, the side portions 45*a*, 45*b* include the opening 47*a*, 47*b*, which is substantially circular. In other implementations, the opening 47*a*, 47*b* may have an alternative geometric configuration, such as oval or square shaped. Moreover, and as illustrated in FIG. 3A, the opening 47*a*, 47*b* can be configured to match the geometric configuration of the engagement ring 50.

As mentioned above, the side portions 45*a*, 45*b* secure the engagement ring 50. In general, the side portions 45*a*, 45*b* securely attach the engagement ring 50 to the strap 20, and the engagement ring 50 securely engages the speaker assemblies 15*a* or 15*b* (FIG. 2A-2C). Thus, the speaker assemblies 15*a*, 15*b* are securely associated with the strap 20.

The manner in which the engagement ring 50 attaches to the side portions 45*a*, 45*b* can vary from one implementation to the next. For example, and as illustrated in FIGS. 3A and 3C, the engagement ring 50 can include an inner portion 52 and an outer portion 53 that are connected together by tabs 54 that create a gap 58 between the inner portion 52 and the outer portion 53. Bands of fabric 59 or other material can then be looped through the gap 58 between the inner portion 52 and the outer portion 53. The bands of fabric 59 are positioned between the side portions 45*a*, 45*b* and stitched into place in flaps of side portions 45*a*, 45*b*, such as by way of inner stitching 56 shown in FIG. 3B. In alternative embodiments, the engagement ring 50 can attach to the side portions 45*a*, 45*b* using adhesives, rivets, clips, or other similar techniques.

Just as the attachment of the engagement ring 50 to the strap 20 can vary, so too can the manner in which the speaker assemblies 15*a*, 15*b* engage the engagement ring 50. In one example implementation, the engagement ring 50 includes posts 55*a* (see FIG. 3A) that extend inwardly from the inner portion 52. For example, the side portions 45*a*, 45*b* can be positioned relative to the engagement ring 50 such that at least a portion of the posts 55*a* extend into each of the openings 47*a*, 47*b*. Such a configuration provides access to the posts 55*a* to allow a user to attach a speaker assembly 15*a* thereto (shown in FIG. 2C).

The engagement ring 50 can be formed of a flexibly resilient material to thereby allow the engagement ring 50 to flex and/or expand when a user is attaching a speaker assembly 15*a* or 15*b* to the engagement ring 50. Flexibly resilient materials can include, without limitation, plastic materials, metals, or other materials, as well as combinations thereof.

Just as the material of the engagement ring 50 can vary, so too can the number and positions of the engagement posts 55*a*. For example, and as illustrated in FIG. 3A through 3C, the engagement ring 50 can include two engagement posts 55*a* positioned directly across from one another and located on a substantially horizontal plane with respect to the strap 20. In alternative implementations, the engagement ring 50 can include more or fewer engagement posts 55*a*, and those engagement posts 55*a* can have almost any position with respect to other engagement posts and be located anywhere on the inner portion 52 of the engagement ring 50.

Figure 4B:
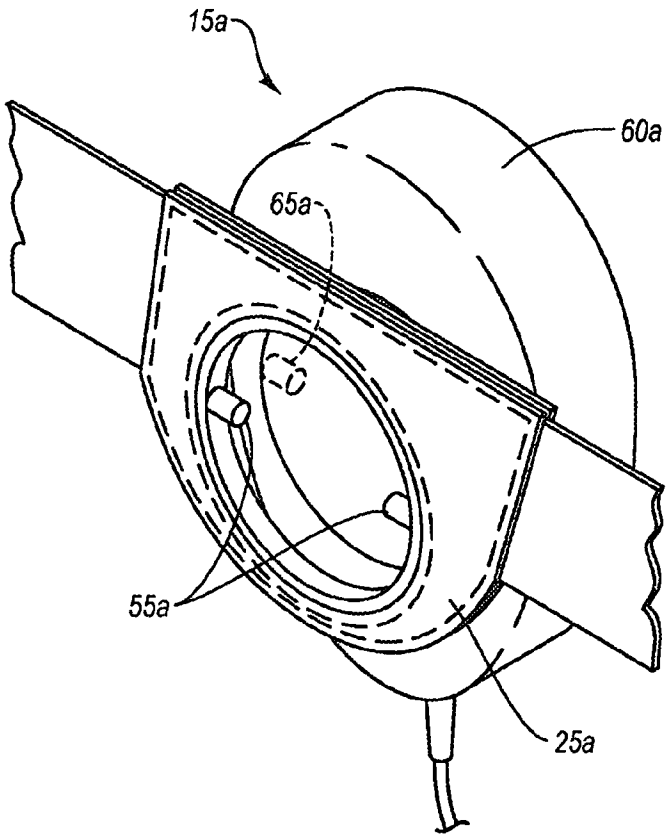
FIG. 4B illustrates a more detailed view of a speaker and an engagement assembly according to an implementation of the present invention.
Figure 4A:
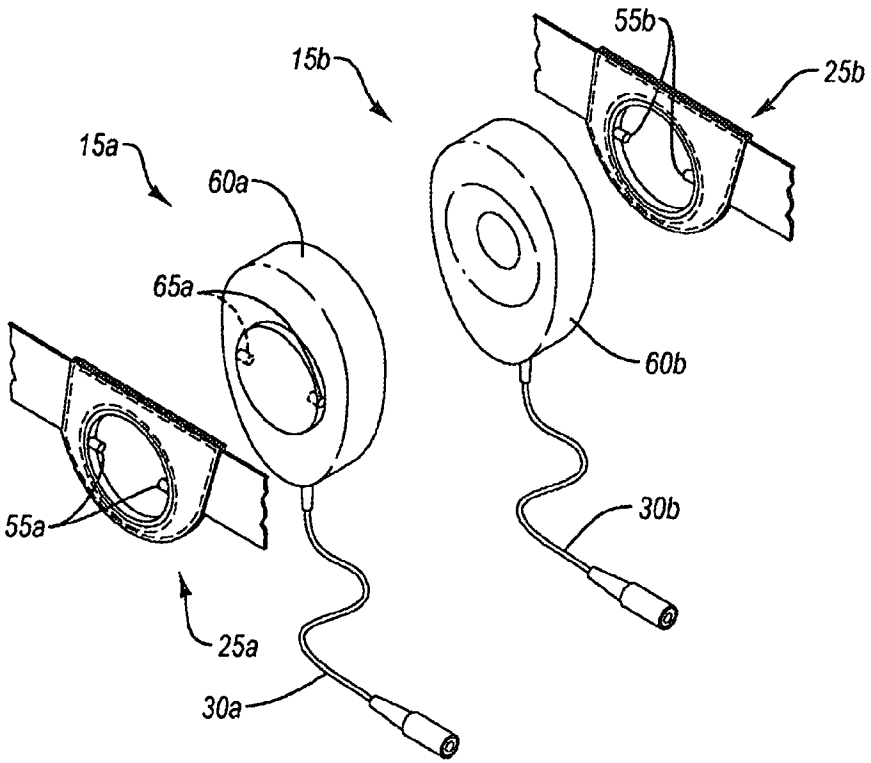
FIG. 4A illustrates a partial perspective view of speakers and engagement assemblies according to an implementation of the present invention.

FIGS. 4A and 4B illustrate an example engagement between speaker assemblies 15*a*, 15*b* and the engagement assemblies 25*a*, 25*b* in accordance with at least one implementation of the present invention. In particular, FIGS. 4A and 4B illustrate that the speaker assemblies 15*a*, 15*b* can each include a housing 60*a*, 60*b*. As shown, recesses 65*a* and 65*b* are defined in each of the housings 60*a* and 60*b*, respectively. The recesses 65*a* and 65*b* are configured to receive the posts 55*a* and 55*b*, and to secure the posts 55*a* and 55*b* within the recesses 65*a* and 65*b* until the user removes the speaker assemblies 15*a* and 15*b* from the engagement assemblies 25*a* and 25*b*.

According to one implementation, to connect the speaker assembly 15*a* to the engagement assembly 25*a*, the user positions one of the recesses 65*a*, 65*b*, such as recess 65*a*, adjacent to post 55*a*. The user then inserts the post 55*a* into the recess 65*a*. The user can then move the other post 55*a* proximate to the corresponding recess 65*a* and apply a force to the engagement ring 50 such that the engagement ring 50 deflects slightly, allowing the other post 55*a* to be inserted into the recess 65*a*. The user can then release the force, thus allowing the engagement ring 50 to deflect back to a rest position to thereby secure both the posts 55*a* in the recesses 65*a* (e.g., completing a "snap-fit"). A similar process can be used to couple the other speaker assembly 15*b* to the other engagement assembly 25*b*.

To decouple the speaker assembly 15*a* from the engagement assembly 25*a*, the user can apply a force to the engagement ring 50 such that the engagement ring 50 deflects sufficiently to allow the user to move one of the posts 55*a* out of engagement with the corresponding recess 65*a* in the housing 60*a*. The user can then pivot the speaker assembly 15*a* away from the engagement assembly 25*a* and remove the other post 55*a* from the other recess 65*a* such that the entire speaker assembly 15*a* is removed from the engagement assembly 25*a*. One will appreciate that a user can decouple the posts 55*a* in any order or manner.

The implementation discussed above with respect to FIGS. 3A through 4B show only one example of a configuration of connecting the speaker assemblies 15*a*, 15*b* to the engagement assemblies 25*a*, 25*b*. In alternative embodiments, for example, various other configurations and techniques can be used to achieve a secure connection between the speaker assemblies 15*a*, 15*b* and the engagement assemblies 25*a*, 25*b*. For example, in another implementation the speaker assemblies can include posts that are configured to engage recesses that are located in the engagement ring. In another example, the speaker assemblies can include one or more magnets that correspond to one or magnetic surfaces on the engagement ring. Moreover, various types of clips or securing devices can be incorporated to secure the speaker assemblies 15*a*, 15*b* to the engagement assemblies 25*a*, 25*b*.

Figure 5B:
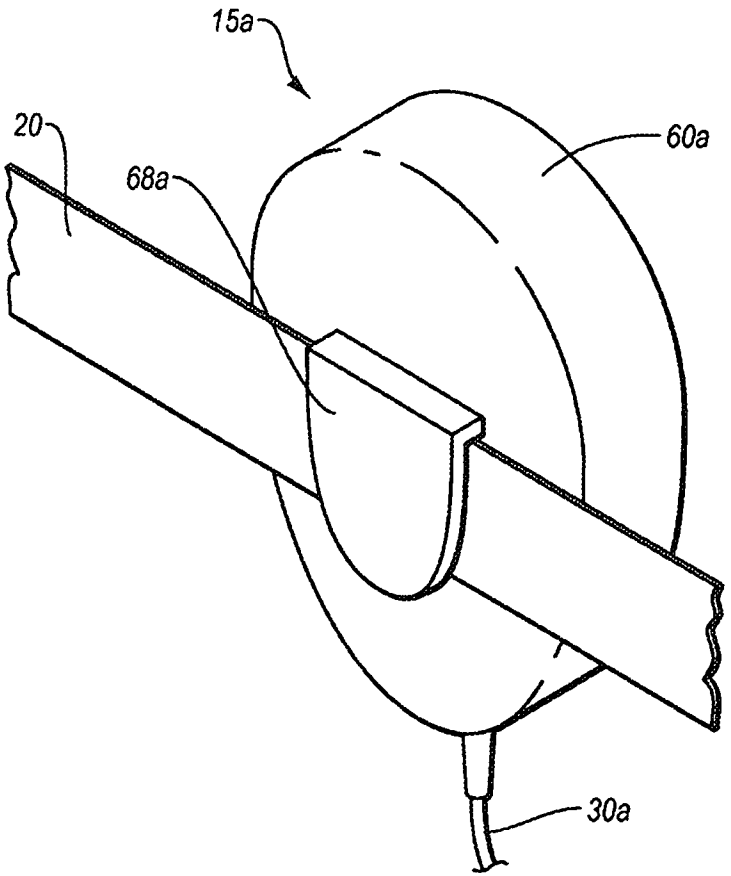
FIGS. 5A and 5B illustrate an example implementation of a speaker assembly according to the present invention.
Figure 5A:
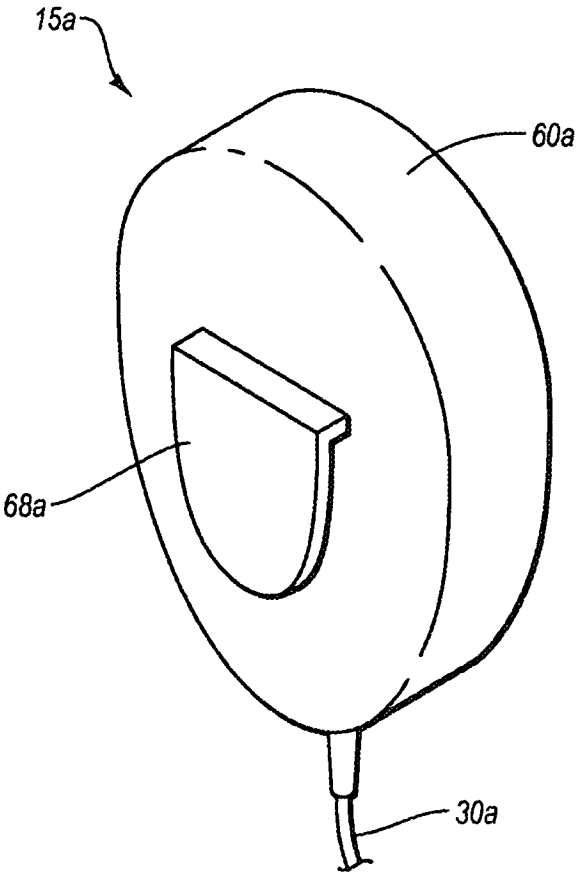

Specifically, FIGS. 5A and 5B illustrate one example implementation that includes a clip 68*a* that is located on the speaker assembly 15*a*. In particular, the clip 68*a* is positioned on the back of the housing 60*a* such that the clip 68*a* can slide over the strap 20, as shown in FIG. 5B. In one implementation, the clearance between the clip 68*a* and the housing 60*a* is such that a user must apply a force sufficient to deflect the clip 68*a* slightly away from the housing 60*a* in order to slide the strap 20 between the clip 68*a* and the housing 60*a*. Once the user positions the strap 20 between the clip 68*a* and the housing 60*a*, the user can release the force and the clip 68*a* will securely grip the strap 20 between the clip 68*a* and the housing 60*a*.

Figure 6A:
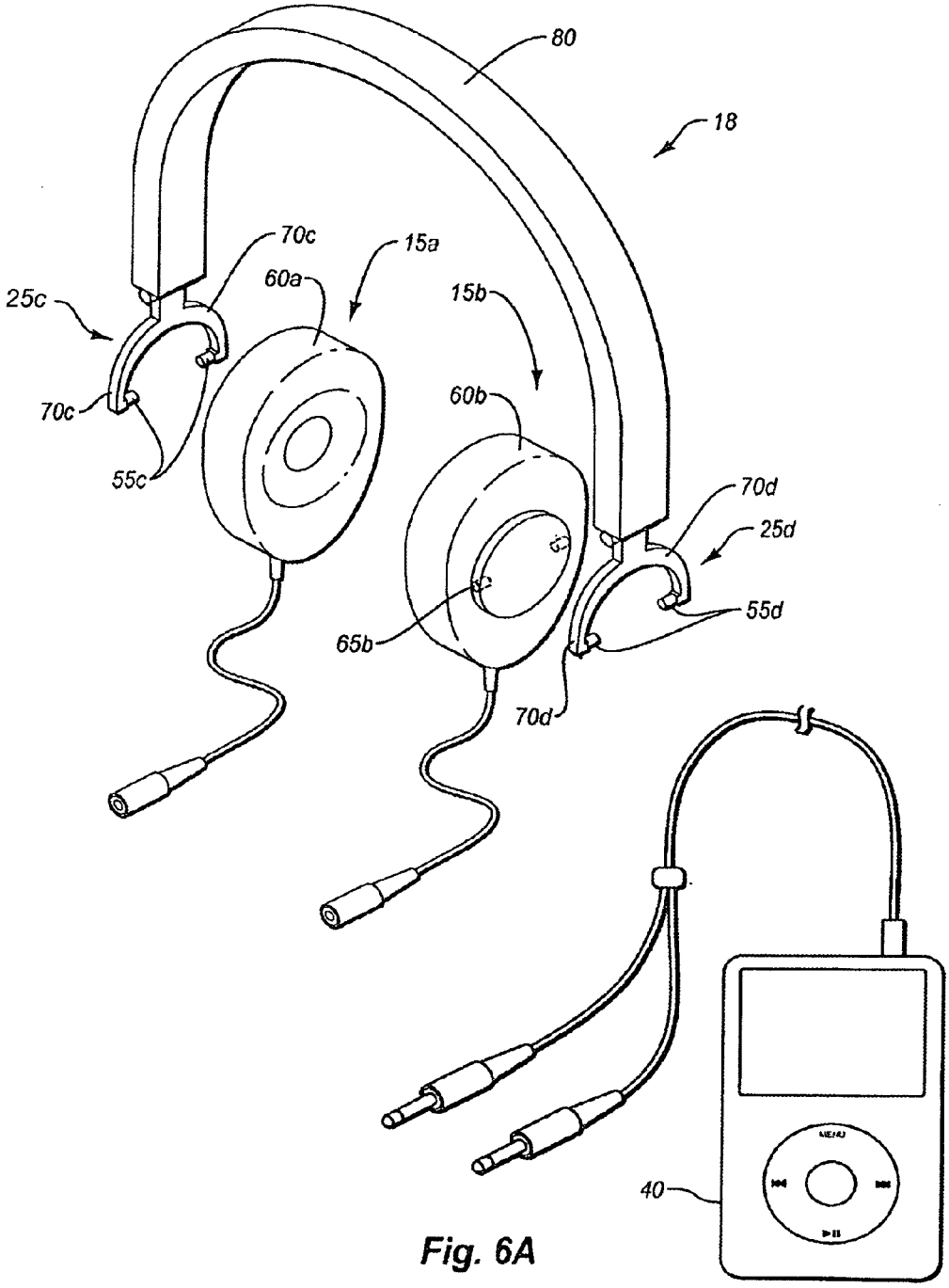
FIG. 6A illustrates a partial perspective view of speakers and an engagement assembly according to an implementation of the present invention.
Figure 6B:
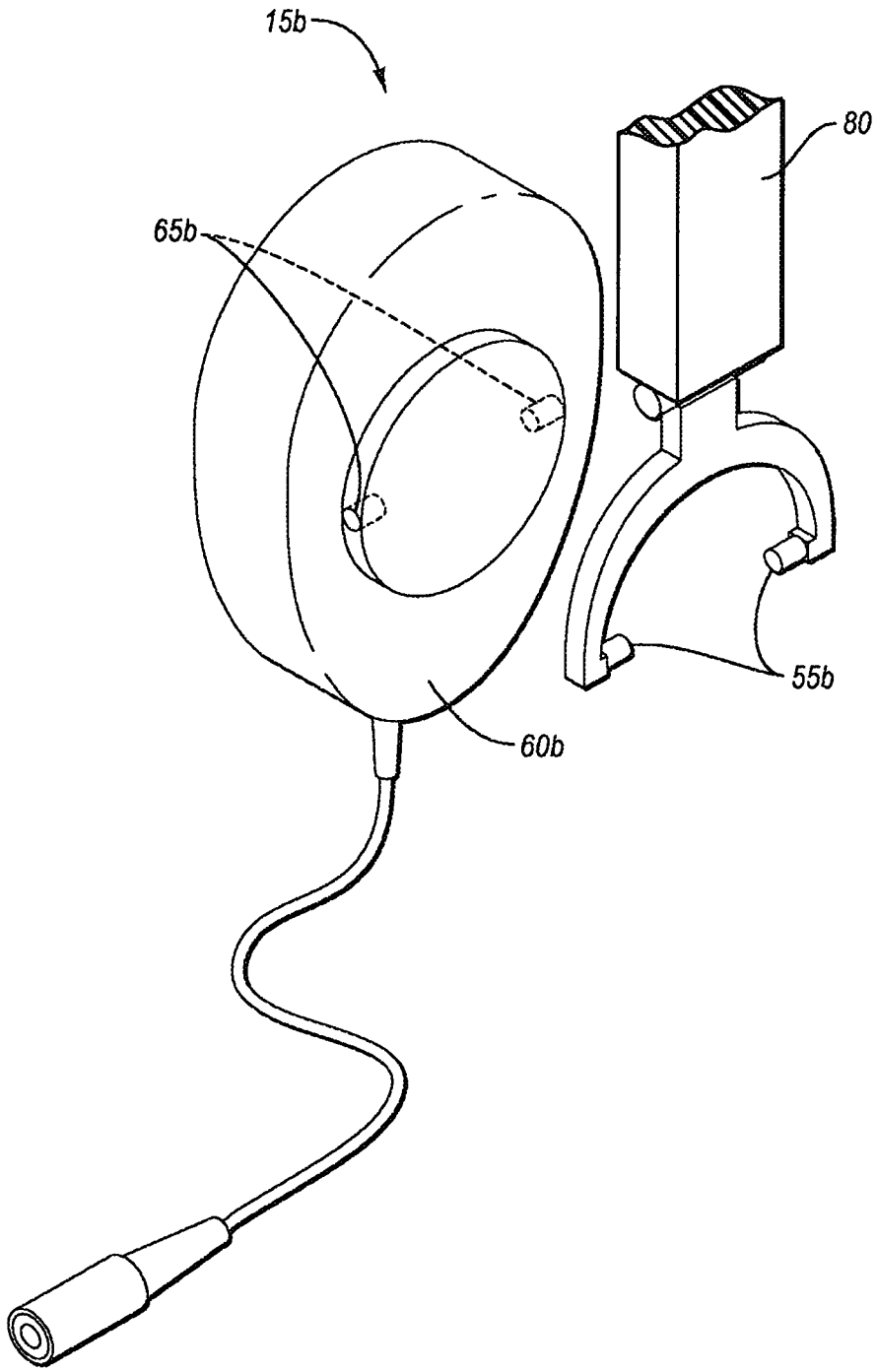
FIG. 6B illustrates additional details of the speaker and engagement assembly shown in FIG. 6A.

Notwithstanding the manner in which the speaker assemblies are connected to the engagement assemblies, other accessories can be designed with the same or similar engagement assemblies such that a user can associate the speaker assemblies 15*a*, 15*b* with several different accessories. For example, FIGS. 6A and 6B illustrate the how a user can associate the speaker assemblies 15*a*, 15*b* with a traditional headphone band. In one example implementation, the traditional headphone band 18 includes a flexible headband 80 configured to conform about a user's head, and an engagement assembly 25*c*, 25*d* coupled to the headband 80. Each engagement assembly 25*c*, 25*d*, in turn, includes opposing arms 70*c* and 70*d*, respectively. The opposing arms 70*c*, 70*d* include posts 55*c* and 55*d*, respectively.

As with the engagement ring 50, discussed in FIGS. 3A to 4B, the opposing arms 70*c*, 70*d* can be formed of a flexible material (e.g., flexible rubber, plastics, metals, and combinations thereof) to allow the opposing arms 70*c*, 70*d* to be deflected away from each other. Moreover, and also similar to the engagement ring 50, the posts 55*c*, 55*d* can engage a corresponding recess 65*a*, 65*b* in the speaker housing 60*a*, 60*b*, much like as described with respect to FIGS. 3A through 4B. For example, either or both of the opposing arms 70*c*, 70*d* can then be deflected to allow each of the posts 55*c*, 55*d* to be secured to the speaker assembly 15*c*, 15*b*. Either or both of the opposing arms 70*c*, 70*d* can be deflected to decouple the opposing arms 70*c*, 70*d* from the speaker assembly 15*c*, 15*b*. Accordingly, the speaker assemblies 15*a*, 15*b* can be selectively coupled to the traditional headphone band 18 for a user to enjoy the media content from the media player 40 in a more casual setting.

One will appreciate, therefore, that implementations of the present invention can enable a user to effectively use one preferred style or fit of headphones in a variety of locations and environments. Specifically, the primarily over-the-ear style headphones illustrated or described herein can be easily replaced with other forms, styles, and/or fits of speaker assemblies. In sum, all that is required is that the chosen speaker assemblies of any given headphone have the same style or configuration of engagement assemblies for connecting with a headband, a set of goggles, or various other accessories.

On the one hand, this can allow a user to avoid having to purchase several different headphones for use with the same media player as part of a portable audio system. On the other hand, this can similarly allow the user to purchase multiple different styles and fits of interchangeable headphones with which the user can interchange with any accessory. For example, the user may prefer a particular look or fit of speaker assembly about the user's ear, and similarly have several different styles or fits of straps 20 on a set of goggles (or the like), and/or several different styles or fits of headbands 80. The user can then mix and match the look and feel of speaker assemblies with any particular (and appropriately configured) engagement assembly 25*a*-25*d*.

The present invention thus can be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

I claim:

1. An audio kit, comprising:

a headband configured to carry a speaker assembly on each side of two sides of the headband and to position each speaker assembly proximate an ear of a user;

a user-wearable accessory comprising a pair of goggles comprising a flexible strap and two engagement assemblies attached to the flexible strap, each engagement assembly configured to carry a speaker assembly on each side of two sides of the user-wearable accessory and to position each speaker assembly proximate an ear of a user, wherein each engagement assembly comprises a ring attached to the flexible strap of the user-wearable accessory; and two speaker assemblies configured in size and shape to repeatedly attach to and detach from each side of the two sides of the headband and the two engagement assemblies without damaging the speaker assemblies, the two sides of the headband, and the two engagement assemblies.

2. The audio kit of claim 1, wherein each side of the two sides of the headband comprises an engagement assembly configured to attach to a speaker assembly of the two speaker assemblies.

3. The audio kit of claim 2, wherein each engagement assembly is positioned at an end of each side of the two sides of the headband.

4. The audio kit of claim 2, wherein each engagement assembly comprises opposing arms configured to attach to a speaker assembly of the two speaker assemblies.

5. The audio kit of claim 2, wherein each engagement assembly comprises one of at least one post configured for insertion into at least one recess and at least one recess configured to receive at least one post and wherein each speaker assembly comprises the other of at least one recess configured to receive at least one post and at least one post configured for insertion into at least one recess.

6. The audio kit of claim 1, wherein at least one speaker assembly of the two speaker assemblies comprises a local wire extending from the at least one speaker assembly configured for connection to another structure.

7. The audio kit of claim 6, wherein the local wire comprises a female socket at the end of the local wire.

8. The audio kit of claim 6, further comprising a main wire configured to connect to the local wire and to a media player.

9. The audio kit of claim 1, further comprising another user-wearable accessory selected from the group consisting of a pair of sunglasses, a helmet, a skull cap, a hood, and a collar configured to carry the two speaker assemblies and to position each speaker assembly proximate an ear of a user.

10. The audio kit of claim 1, wherein each engagement assembly is attached to the flexible strap of the user-wearable accessory using one of stitching, adhesive, riveting, and wherein each engagement assembly further comprises at least one clip and two posts extending inwardly toward a central axis of the ring and each speaker assembly comprises two recesses into which the posts are configured to be inserted.

11. The audio kit of claim 1, wherein each engagement assembly comprises one of at least one post configured for insertion into at least one recess and at least one recess configured to receive at least one post and wherein each speaker assembly comprises the other of at least one recess configured to receive at least one post and at least one post configured for insertion into at least one recess.

12. The audio kit of claim 1, wherein the ring of each engagement assembly is attached to the flexible strap of the pair of goggles using one of stitching, adhesive, riveting, and at least one clip.

13. An audio system, comprising:

a user-wearable accessory comprising a pair of goggles comprising a flexible strap and two engagement assemblies attached to the flexible strap, each engagement assembly configured to carry a speaker assembly and to position each speaker assembly proximate an ear of a user, wherein each engagement assembly comprises a ring attached to the flexible strap of the user-wearable accessory; and two speaker assemblies, each speaker assembly configured in size and shape to repeatedly attach to and detach from the two engagement assemblies without damaging the speaker assemblies or the two engagement assemblies.

14. The audio system of claim 13, wherein each speaker assembly comprises one of at least one post configured for insertion into at least one recess and at least one recess configured to receive at least one post and wherein each engagement assembly comprises the other of at least one recess configured to receive at least one post and at least one post configured for insertion into at least one recess.

15. The audio system of claim 14, wherein each speaker assembly is configured to engage with a respective engagement assembly using a snap-fit.

16. The audio system of claim 14, wherein each engagement assembly is attached to the flexible strap using one of stitching, adhesive, riveting, and wherein each engagement assembly further comprises at least one clip and two posts extending inwardly toward a central axis of the ring and each speaker assembly comprises two recesses into which the posts are configured to be inserted.

17. The audio system of claim 13, wherein a local wire extends from each speaker assembly.

18. The audio system of claim 17, wherein ends of the local wires opposing the speaker assemblies join to one another.

19. The audio system of claim 13, wherein a local wire extends from only one speaker assembly of the two speaker assemblies and a direct electrical connection extends between the two speaker assemblies.

* * * * *